US005149239A

United States Patent [19]

Honma et al.

[11] Patent Number: 5,149,239

[45] Date of Patent: Sep. 22, 1992

[54] MECHANISM FOR ESTABLISHING CLEARANCE BETWEEN SEAMING CAM LEVER AND HOUSING OF CAN END DOUBLE-SEAMING MACHINE

[75] Inventors: Toru Honma, Ohmiya; Izumi Matsushita, Koshigaya; Yoshiteru Kojika, Saitama; Noboru Sasaki, Kitamoto, all of Japan

[73] Assignee: Hokkai Can Co., Ltd., Tokyo, Japan

[21] Appl. No.: 734,678

[22] Filed: Jul. 23, 1991

[30] Foreign Application Priority Data

Jul. 25, 1990 [JP] Japan ..... 2-195030

[51] Int. Cl.[5] ..... B65B 7/28; B21D 51/26

[52] U.S. Cl. ..... 413/31; 53/340

[58] Field of Search ..... 413/27–40; 53/334, 336, 338, 339, 340

[56] References Cited

U.S. PATENT DOCUMENTS

| | | | |
|---|---|---|---|
| 1,370,039 | 3/1921 | Newman | 413/40 |
| 1,819,249 | 8/1931 | Lange | 413/32 |
| 3,797,431 | 3/1974 | Yoshimura | 113/120 AA |
| 4,961,300 | 10/1990 | Mihara | 413/27 |

FOREIGN PATENT DOCUMENTS

| | | |
|---|---|---|
| 0041302 | 12/1981 | European Pat. Off. . |
| 3730165 | 3/1989 | Fed. Rep. of Germany . |

*Primary Examiner*—Bruce M. Kisliuk
*Assistant Examiner*—Jack W. Lavinder

[57] ABSTRACT

A can end double-seaming machine has a housing in which a shaft is rotatably supported. The shaft with a seaming cam lever mounted is pressed downwardly by a presser against the bias of a spring until the lower surface of the seaming cam lever is held against the upper surface of the housing. Then, an annular spacer is fitted over the lower end portion of the shaft underneath, with the tubular support held against a neck of the shaft. A seaming roll lever is then mounted on the lower end portion of the shaft. The presser is deactivated to release the shaft, which is lifted together with the seaming cam lever, the annular spacer, and the seaming roll lever under the bias of the spring until the marginal portion of the annular spacer abuts against the lower surface of the housing. The tubular support enters the housing by a distance corresponding to a predetermined clearance. The seaming cam lever and the housing are now spaced from each other by the predetermined clearance.

7 Claims, 4 Drawing Sheets

PRIOR ART

MECHANISM FOR ESTABLISHING CLEARANCE BETWEEN SEAMING CAM LEVER AND HOUSING OF CAN END DOUBLE-SEAMING MACHINE

BACKGROUND OF THE INVENTION

1. Field of the Invention

The present invention relates to a mechanism for establishing the clearance between a housing and a seaming cam lever for swinging a pair of seaming rolls in a machine for double-seaming, a can end on a can body.

2. Description of Background Art

Can end double-seaming machines generally have, as major components, a lifter, a seaming chuck, and a seaming roll. When a can end is to be seamed on a can body, the cam body which is supported on the lifter and the can end which is placed on the can body with the seaming chuck fitted therein are held between the seaming chuck and the lifter. Then, the seaming roll is moved toward the seaming chuck, seaming the can end on the can body by plastically deforming a cover hook of the can end and a flange of the can body in interengaging relationship to each other. The seaming roll comprises first and second seaming rolls. The first seaming roll effects a first stage of seaming, and then the second seaming roll effects a second stage of seaming, thereby double-seaming the can end on the can body.

FIG. 4 shows a known mechanism (hereinafter referred to as a seaming roll mechanism) including the seaming roll of the double-seaming machine.

The seaming roll mechanism comprises a housing a rotatable around a main shaft (not shown) of the doubleseaming machine, and an angularly movable shaft b extending vertically through a hole a1 defined in a marginal edge portion of the housing a and extending between upper and lower surfaces of the housing a. The shaft b has an upper end b1 projecting above the upper surface of the housing a, and a seaming cam lever c is integrally fitted over the projecting end b1 of the shaft b. The shaft b also has a lower end b2 projecting below the lower surface of the housing a, and a seaming roll lever d is integrally fitted over the projecting end b2. The seaming lever c, the shaft b, and the seaming roll lever d are normally urged upwardly by a spring e inserted in an upper portion of the housing and held against the seaming cam lever c through a plug f.

A pair of roll pins g is vertically inserted in the seaming lever d at positions one on each side of the shaft b. The roll pins g have lower ends projecting below the seaming roll lever d, and first and second seaming rolls h, i are rotatably fitted over the projecting lower ends of the roll pins g. The seaming roll lever d is threaded over the lower end b2 of the shaft b. A lock screw j is threaded through a side of the seaming roll lever d toward the shaft b, and has a tip end pressed against the bottom of a recess k which is defined in a side of the lower end of the shaft b, thereby fixing seaming roll lever d to the shaft b. A pair of washers l is interposed between the upper surface of the seaming roll lever d and the lower surface of the housing a, the washers l being disposed around the shaft b.

The seaming cam lever c has a cam follower pin n that is vertically fixed to a distal end of an arm m which extends horizontally from a portion of the seaming cam lever c which is securely fitted over the upper end of the shaft b. A cam follower o is rotatably mounted on the cam follower pin n by bearings r. The cam follower o is rollingly disposed in a cam groove q which is defined in a cam frame p that is positioned above the housing a. The cam groove q extends around the main shaft of the doubleseaming machine such that when the housing a and the shaft b are angularly moved around the main shaft, the cam groove q guides the cam follower pin n to turn the shaft b around the axis thereof. As the housing a is angularly moved around the main shaft, the seaming cam lever c is turned by the cam follower o riding in the cam groove q to angularly move the shaft b to turn the seaming roll lever d, thus angularly moving the first and second seaming rolls h, i successively toward the seaming chuck s.

The shaft b is disposed in the housing a with bushings u, v interposed therebetween. An expandable and contractable O-ring x is interposed between the lower end of the lower bushing v and the upper washer l.

Normally, there is a clearance Cl between the lower surface of the seaming cam lever c and the upper surface of the housing a. The clearance Cl allows the seaming cam lever c to move smoothly with respect to the housing a even when the seaming cam lever c is thermally expanded while operating at high speed during operation of the double-seaming machine.

As shown in FIG. 5, it is generally necessary to keep the seaming roll h, i and the seaming chuck s vertically spaced by a gap t of several tens μm in order to avoid mutual interference between the seaming rolls h, i and the seaming chuck s when the seaming rolls h, i and the seaming chuck s approach each other, thereby allowing the can end to be seamed appropriately on the can body. When shaft b turns the seaming roll lever d, the shaft b may be depressed under the bias of the spring e. Therefore, the clearance Cl should be set up with the same accuracy as that for the gap t so that the clearance Cl will not adversely affect the gap t.

Heretofore, the clearance Cl has been set to a desired magnitude by manually adjusting the seaming roll lever d with respect to the shaft b when the seaming roll lever d is to be fixedly mounted on the shaft b.

More specifically, the shaft b with the seaming cam lever c attached to the upper end thereof is inserted vertically through the housing a. Then, while the shaft b and the seaming cam lever c are being lowered against the bias of the spring e, the seaming roll lever d is threaded over the lower end of the shaft b. To establish the clearance Cl, the seaming roll lever d is threaded up to a suitable position on the lower end of the shaft b. Thereafter, the seaming roll lever d is brought against the lower surface of the housing a through the washers l under the resiliency of the spring e. In order to set up the gap t as well as the clearance Cl, the threaded position of the seaming roll lever d is adjusted while measureing the gap t and the clearance Cl with a thickness gage, a dial gage, or the like. After such adjustment, the seaming roll lever d is secured to the shaft b by the lock screw j.

Therefore, it has been customary to adjust the gap t between the seaming rolls h, i and the seaming chuck s below the housing a while measuring the gap t with a thickness gage or the like, and also to adjust the fixed position of the seaming roll lever d with respect to the shaft b below the housing a while measuring the clearance Cl with a dial gage or the like. Consequently, it has been cumbersome and time-consuming to establish the clearance Cl, and it has taken a long period of time to install the seaming roll lever d in position.

SUMMARY OF THE INVENTION

In view of the foregoing drawbacks of the conventional can end double-seaming machine, it is an of the present invention to provide a mechanism for easily setting a clearance between a seaming cam lever and a housing to a desired magnitude and also for installing a seaming roll lever efficiently in a relatively short period of time.

According to the present invention, the above object can be achieved by a can end double-seaming machine comprising a housing having a vertical hole defined therein and extending between upper and lower surfaces thereof, a shaft rotatably extending through the vertical hole and having upper and lower end portions projecting from the upper and lower surfaces, respectively, of the housing, and a neck on the lower end portion thereof, a seaming cam lever mounted on the upper end portion of the shaft for rotation therewith about an axis of the shaft, a seaming roll lever mounted on the lower end portion of the shaft for rotation therewith about the axis of the shaft, a pair of seaming rolls rotatably mounted on a lower end of the seaming roll lever, biasing means in the housing, for normally urging the shaft, the seaming roll lever, and the seaming cam lever upwardly, and a mechanism for establishing a predetermined clearance between a lower surface of the seaming cam lever and the upper surface of the housing. The mechanism comprises an annular spacer disposed around the shaft between the seaming roll lever and the lower surface of the housing, the annular spacer comprising a marginal portion held against the lower surface of the housing with the seaming roll lever, the shaft, and the seaming cam lever being urged upwardly by the biasing means, and a tubular support disposed around the shaft and projecting integrally from the marginal portion toward the hole in the housing, the shaft being supported on the tubular support through the neck with the seaming cam lever spaced from the upper surface of the housing by a predetermined clearance while the marginal portion is being held against the lower surface of the housing. The mechanism also comprises pressing means for pressing the shaft downwardly until the lower surface of the seaming cam lever is held against the upper surface of the housing when the annular spacer is disposed around the shaft and the seaming roll lever is mounted on the lower end portion of the housing.

To mount the seaming roll lever on the lower end portion of the shaft, the shaft with the seaming cam lever mounted is inserted through the hole in the housing, and pressed downwardly by the pressing means against the bias of the biasing means until the lower surface of the seaming cam lever is held against the upper surface of the housing. Then, the annular spacer is fitted over the lower end portion of the shaft underneath the housing, with the tubular support being brought into abutting engagement with the neck of the shaft. Thereafter, the seaming roll lever is mounted on the lower end portion of the shaft.

Subsequently, the pressing means is inactivated to release the shaft, which is lifted together with the seaming cam lever, the annular spacer, and the seaming roll lever under the bias of the biasing means until the marginal portion of the annular spacer abuts against the lower surface of the housing. At this time, with the marginal portion of the annular spacer being held against the lower surface of the housing, the tubular support enters the hole in the housing by a distance corresponding to a predetermined clearance. The lower surface of the seaming cam lever and the upper surface of the housing are now spaced from each other by the predetermined clearance.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
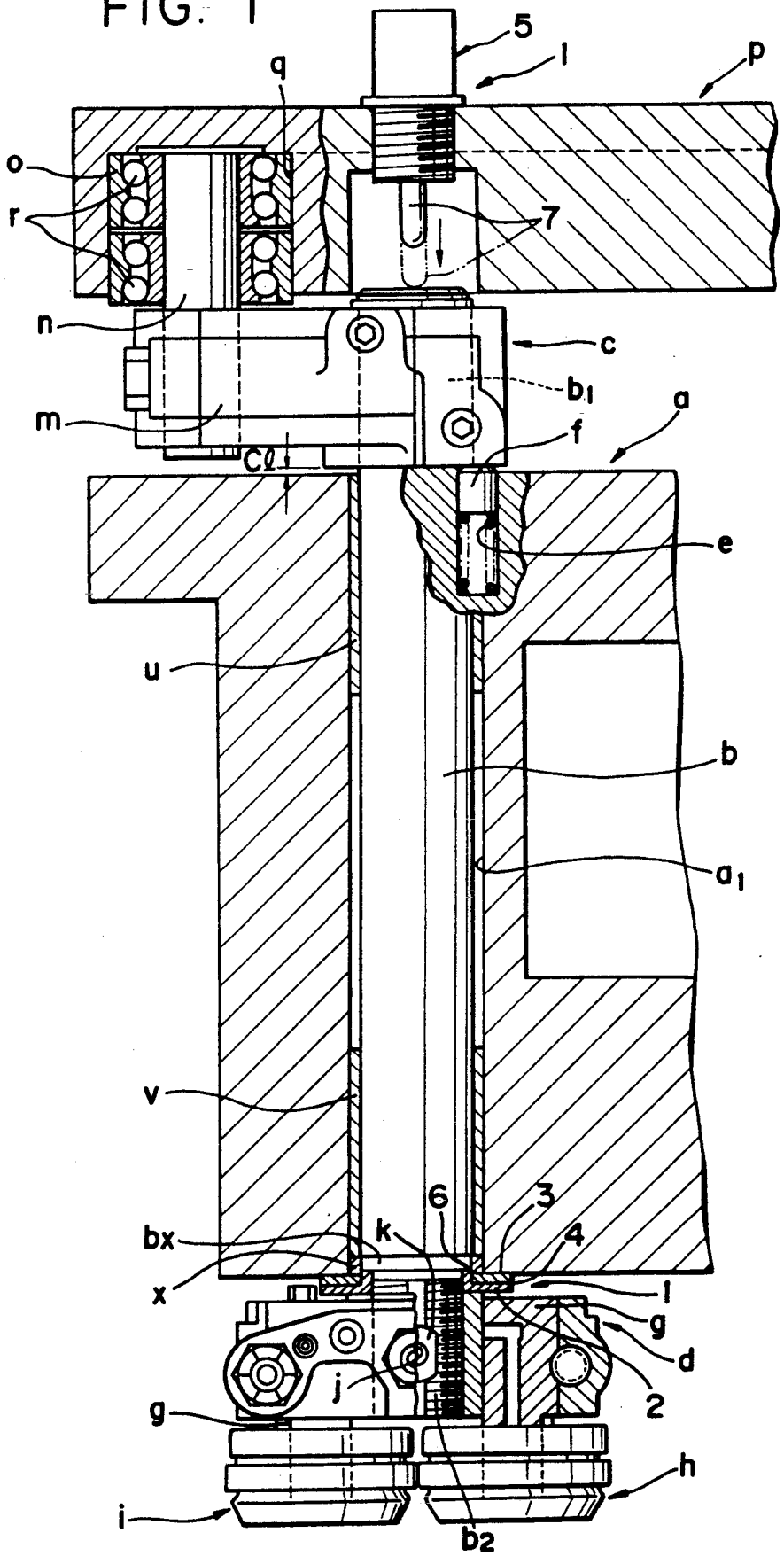
FIG. 1 is a vertical cross-sectional view of a seaming roll mechanism which incorporates a mechanism for establishing a clearance according to the present invention.
Figure 4:
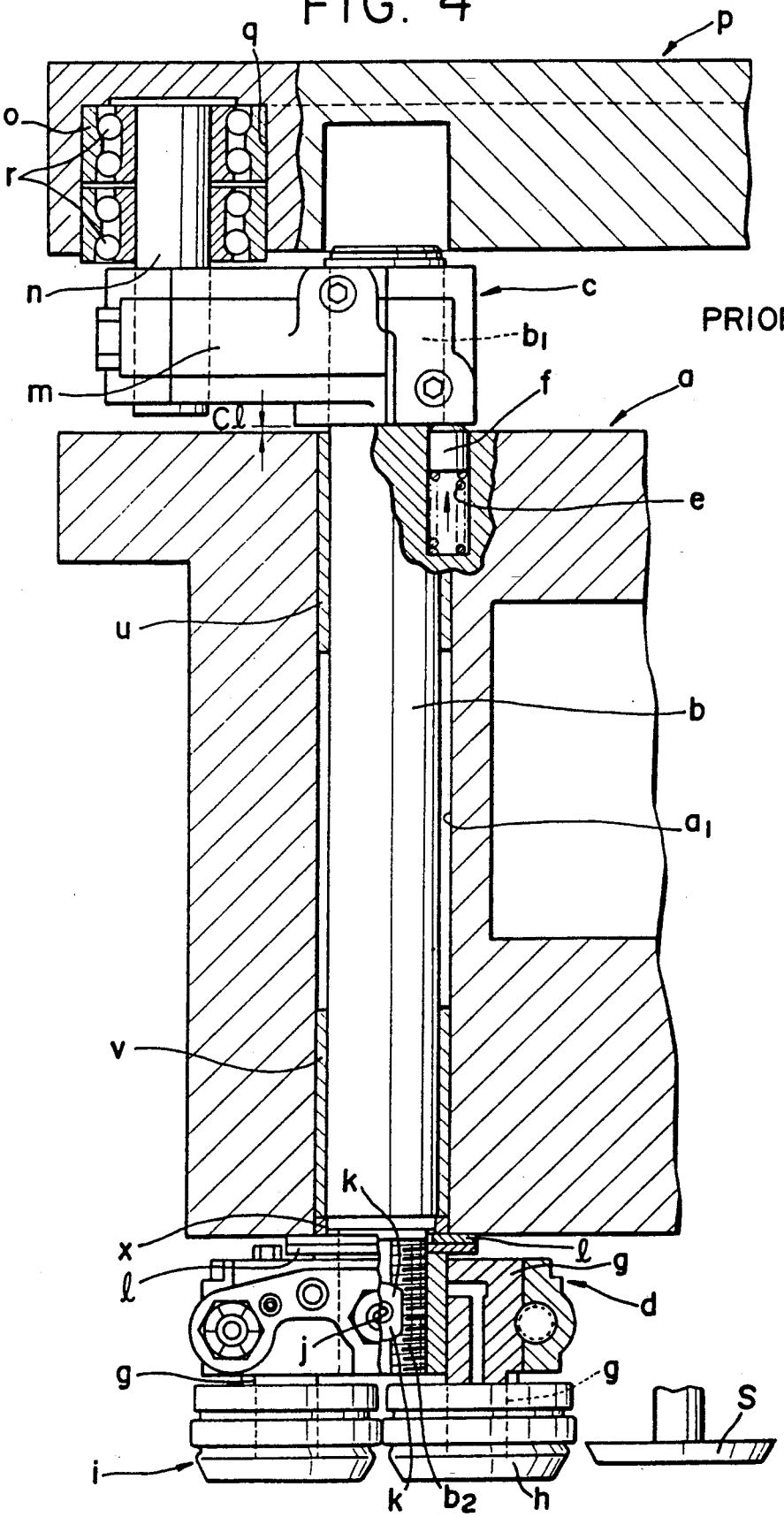
FIG. 4 is a vertical cross-sectional view of a seaming roll mechanism which incorporates a conventional mechanism for establishing a clearance.
Figure 5:
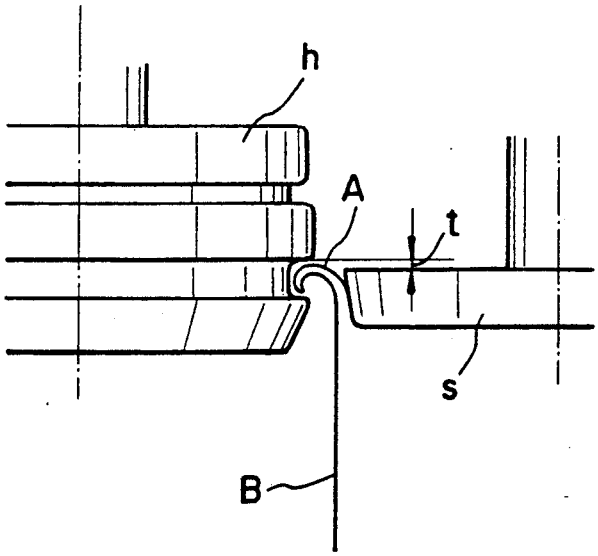
FIG. 5 PRIOR ART
FIG. 5 is an enlarged fragmentary elevational view illustrative of the positional relationship between a seaming chuck and a seaming roll in the mechanism shown in FIG. 4.

As shown in FIG. 1, a seaming roll mechanism generally comprises a housing a, a shaft b, a seaming cam lever c, a seaming cam lever d, first and second seaming rolls h, i, and a spring e for normally urging the shaft b and components combined therewith. These components of the seaming roll mechanism are basically identical to those of the seaming roll mechanism shown in FIG. 4. Those parts shown in FIG. 1 which are identical to those shown in FIG. 4 are denoted by identical reference characters, and will not be described in detail. The seaming roll mechanism shown in FIG. 1 additionally has a clearance establishing mechanism 1 according to the present invention.

The clearance establishing mechanism 1 comprises an annular spacer 4 composed of a pair of lower and upper annular discs 2, 3 fitted concentrically over a lower end portion of the shaft b, and a presser 5 for pressing the shaft b together with the seaming cam lever c and the seaming roll lever d downwardly.

Figure 2:
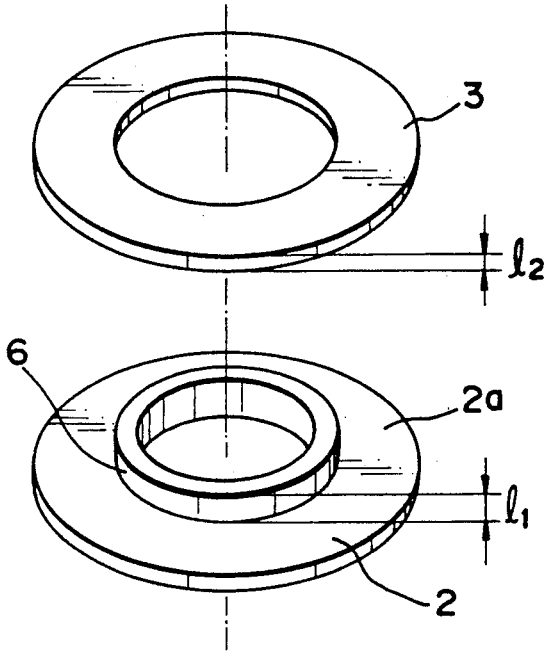
FIG. 2 is an exploded perspective view of annular spacers.

As shown in FIG. 2, the lower annular disc 2 of the annular spacer 4 has a tubular support 6 insertable in a central hole defined in the upper annular disc 3 and projecting concentrically upwardly from an inner peripheral edge of the upper surface of a marginal portion 2*a* of the lower annular disc 2. The upper annular disc 3 is fitted concentrically over the tubular support 6 and has a lower surface held against the upper surface of the marginal portion 2*a* of the lower annular disc 2 around the annular support 6.

The annular support 6 has an upper end projecting upwardly from the upper surface of the upper annular disc 3 by a distance Cl.

The shaft b has a neck bx on its lower end portion, the neck bx having a smaller diameter than the outside diameter of the shaft b. With the shaft b lowered until the seaming cam lever c held against the upper surface of the housing a, the annular spacer 4 can be fitted over the lower end portion of the shaft b which projects downwardly from the housing a until the upper end of the tubular support 6 abuts against the neck bx. The distance by which the tubular support 6 projects upwardly from the upper surface of upper annular disc 3 is selected to allow a gap, which is the same as the clearance Cl to be provided between the seaming cam lever c and the housing a, to be formed between the upper surface of the upper annular disc 3 and the lower surface of the housing a with the shaft b being lowered until the seaming cam lever c is held against the upper surface of the housing a. Therefore, the annular support 6 has a height l1 which is greater than the thickness l2 of the annular disc 3 by the clearance Cl.

The presser 5 comprises an air piston and cylinder assembly fixedly mounted on the cam frame p directly above the shaft b and extending axially aligned with the shaft b. The air piston and cylinder assembly 5 has a piston rod 7 movably extending toward the shaft b. When the piston rod 7 is extended, it engages the upper end of the shaft b and lowers the shaft b against the bias of the spring e until the seaming cam lever c abuts against the upper surface of the housing a.

The clearance establishing mechanism 1 operates as follows:

To mount the seaming roll lever d on the shaft b, the shaft b with the seaming cam lever c mounted thereon is lowered by the air piston and cylinder assembly 5 as described above. Then, the annular spacer 4 is fitted over the lower end portion of the shaft b, and the tubular support 6 is brought into abutting engagement with the neck bx of the shaft b.

Thereafter, the seaming roll lever d is threaded over the externally threaded lower end portion of the shaft b until the upper surface of the seaming roll lever d is held against the lower surface of the annular spacer 4. At this time, the annular spacer 4 is horizontally sandwiched between the neck bx of the shaft b and the seaming roll lever d. Now, a gap, which is the same as the clearance Cl to be formed between the seaming cam lever c and the housing a, is formed between the upper surface of the upper annular disc 3 and the lower surface of the housing a.

Then, the air piston and cylinder assembly 5 is deactivated to release the shaft b. The shaft b, the seaming cam lever c, the seaming roll lever d, and the annular spacer 4 are lifted in unison under the bias of the spring e until the upper surface of the annular disc 3 is engaged by the lower surface of the housing a. The shaft b is now supported on the tubular support 6 through the neck bx. The tubular support 6 is positioned within an annular space defined by the diameter of the neck bx. At this time, since the tubular support 6 moves upwardly and enters the hole a1 in the housing a by a distance which is equal to the clearance Cl to be provided between the seaming cam lever c and the housing a, the seaming cam lever c is lifted off the upper surface of the housing a by the clearance Cl of predetermined magnitude, i.e., the seaming cam lever c is spaced from the upper surface of the housing a by the clearance Cl.

Therefore, the clearance Cl can automatically be established between the seaming cam lever c and the housing a. It is not necessary to make special manual adjustments with respect to the seaming roll lever d, and hence the seaming roll lever d can be mounted in position within a short period of time.

Figure 3:
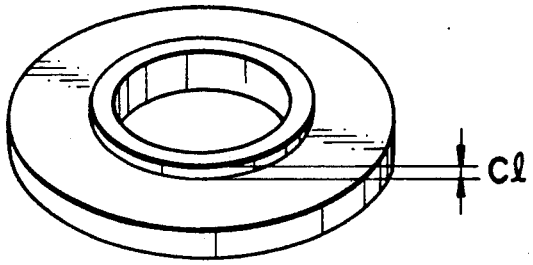
FIG. 3 is a perspective view of an annular spacer according to another embodiment of the present invention.

FIG. 3 shows a single annular spacer according to another embodiment of the present invention, which is a unitary combination of the annular discs 2, 3 of the annular spacer shown in FIG. 2.

In the embodiment shown in FIG. 2, the annular disc 3 should preferably be made of a metallic material, e.g., bronze with phosphor added (ALBC2), which allows the annular disc 3 to slide against the housing a, and the annular disc 2 should preferably be made of a metallic material, e.g., stainless steel (SUS303), which is highly resistant to wear.

Although certain preferred embodiments of the present invention have been shown and described in detail, it should be understood that various changes and modifications may be made therein without departing from the scope of the appended claims.

What is claimed is:

1. A can end double-seaming machine comprising:

a housing having a vertical hole defined therein and extending between upper and lower surfaces thereof;

a shaft rotatably extending through said vertical hole and having upper and lower end portions projecting from the upper and lower surfaces, respectively, of said housing, and a neck on said lower end portion thereof;

a seaming cam lever mounted on said upper end portion of said shaft for rotation therewith about an axis of the shaft;

a seaming roll lever mounted on said lower end portion of said shaft for rotation therewith about the axis of the shaft;

a pair of seaming rolls rotatably mounted on a lower end of said seaming roll lever;

biasing means in said housing, for normally urging said shaft, said seaming roll lever, and said seaming cam lever upwardly;

a mechanism for establishing a predetermined clearance between a lower surface of said seaming cam lever and said upper surface of said housing;

said mechanism comprising:

an annular spacer disposed around said shaft between said seaming roll lever and said lower surface of said housing, said annular spacer comprising a marginal portion held against the lower surface of said housing with said seaming roll lever, said shaft, and said seaming cam lever being urged upwardly by said biasing means, and a tubular support disposed around said shaft and projecting integrally from said marginal portion toward said hole in the housing, said shaft being supported on said tubular support through said neck with said seaming cam lever spaced from the upper surface of said housing by a predetermined clearance while said marginal portion is being held against the lower surface of said housing; and pressing means for pressing said shaft downwardly until the lower surface of said seaming cam lever is held against the upper surface of said housing when said annular spacer is disposed around said shaft and said seaming roll lever is mounted on the lower end portion of said housing.

2. A can end double-seaming machine according to claim 1, wherein said annular spacer comprises an annular disc, said tubular support being integrally disposed centrally on said annular disc.

3. A can end double-seaming machine according to claim 1, wherein said annular spacer comprises a first annular disc, said tubular support being integrally disposed centrally on said first annular disc, and a second annular disc having a hole in which said tubular support is insertable, said first and second annular discs being superimposed on each other with said tubular support inserted in said hole in said second annular disc and partly projecting from said second annular disc.

4. A can end double-seaming machine according to claim 3, wherein said second annular disc is made of a metallic material which allows the second annular disc to slide against said housing when said shaft rotates about the axis thereof.

5. A can end double-seaming machine according to claim 1, wherein said pressing means comprises a piston and cylinder assembly having a piston rod which is positioned for engagement with an upper end of said shaft.

6. A can end double-seaming machine according to claim 1, wherein said neck has a diameter smaller than the outside diameter of said shaft.

7. A can end double-seaming machine according to claim 1, wherein said tubular support is positioned within an annular space defined by the diameter of said neck when the tubular support is disposed around the lower end portion of said shaft.

* * * * *